United States Patent [19]

Babcock

[11] 3,988,124

[45] Oct. 26, 1976

[54] SKATE SHARPENING MACHINE

[76] Inventor: Roger M. Babcock, 18 Bancroft Ave., Wakefield, Mass. 01880

[22] Filed: June 26, 1975

[21] Appl. No.: 590,636

[52] U.S. Cl. ..... 51/96; 51/228; 51/240 R

[51] Int. Cl.[2] ..... B24B 19/26; B24B 41/06

[58] Field of Search ..... 51/96, 228, 100, 240 R; 76/83; 33/386

[56] References Cited

UNITED STATES PATENTS

| | | | |
|---|---|---|---|
| 1,175,702 | 3/1916 | Busler | 51/96 |
| 3,118,256 | 1/1964 | DeWitt | 51/96 |
| 3,719,006 | 3/1973 | Vezeau | 51/100 R |
| 3,789,551 | 2/1974 | Norris | 51/228 X |
| 3,902,277 | 9/1975 | Rupp | 51/96 X |

*Primary Examiner*—Al Lawrence Smith
*Assistant Examiner*—Nicholas P. Godici
*Attorney, Agent, or Firm*—Robert A. Cesari; John F. McKenna; Andrew F. Kehoe

[57] ABSTRACT

An improved contouring tool, advantageously used as a skate sharpening machine, comprising means to vary the contour of the skating blade with respect to its longitudinal arc and also with respect to the centering of the arc. The sharpener of the invention also advantageously incorporates a novel low-friction surface over which a skateholder may be manipulated and a novel skate positioning and bent-blade detection means.

12 Claims, 17 Drawing Figures

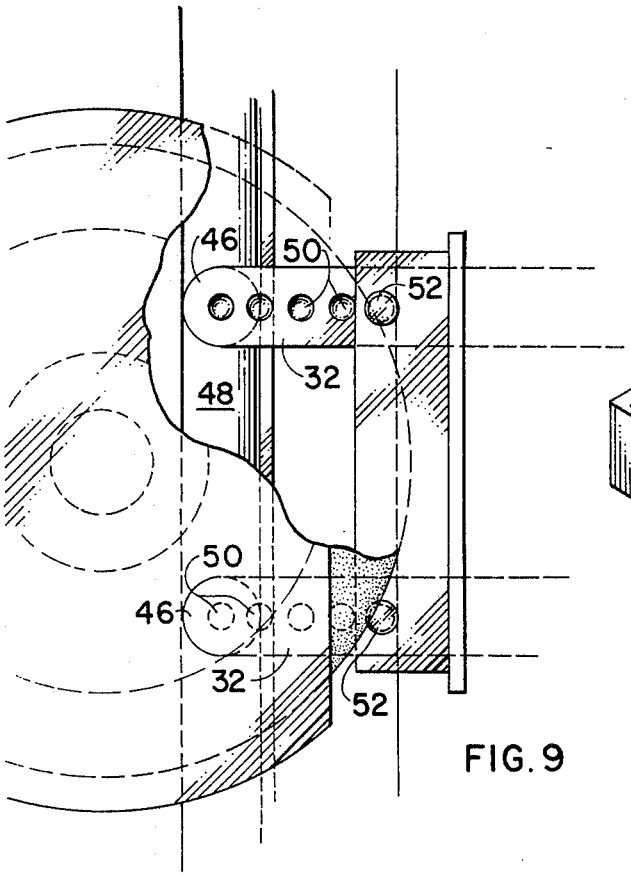
FIG. 9
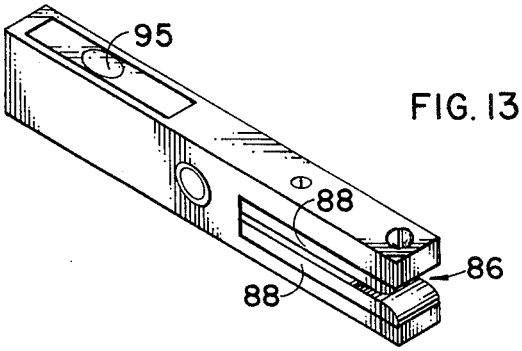
FIG. 13
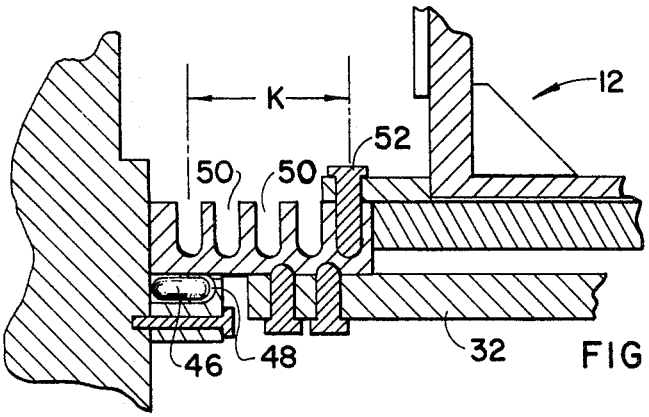
FIG. 10
FIG. 12
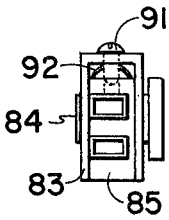
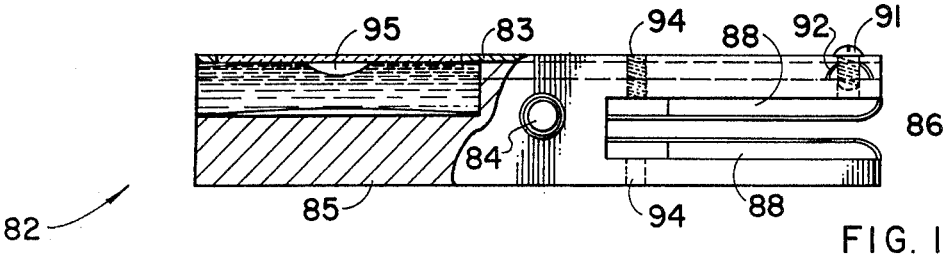
FIG. 11

SKATE SHARPENING MACHINE

BACKGROUND OF THE INVENTION

The most common practice in ice-skate sharpening is the presentation of a blade by hand to a rotating grinding wheel. To obtain good control of blade curvature, while using this technique, requires a great deal of care and skill on the part of the operator. The number of skilled operators is small; consequently, less-than-satisfactory sharpening is a common result.

There have been some attempts to simplify skate-sharpening procedures by improving skate-sharpening machinery. For example, U.S. Pat. No. 3,789,551 discloses a device for establishing and controlling the desired longitudinal contour of an ice skating blade. The skate holder is mounted on a carriage and moved past a rotary grinder. This device does use an indexing mechanism for adjusting the position of the skate blade on the holder to obtain a predetermined skate-to-ice tangency point.

The apparatus described in U.S. Pat. No. 3,789,551 may represent the art most pertinent to the subject invention described hereinafter. However, the apparatus described therein is rather complex; it uses 2 templates to guide the skate during the sharpening process. At least one template change must be made to modify the radius. Moreover, that device requires a reclamping of the skate in the clamp to change the "high point" or tangency of the skate blade. This movement, height adjustment of the skate, and a singlepoint diamond cutting tool all make this known apparatus one which requires a high degree of operator competence and responsibility.

Other ice-skate sharpening devices are disclosed in U.S. Pat. No. 3,839,828 wherein a skate is used as a guide for sharpening another skate. Numerous other devices have been disclosed in the art and these include such devices as cited in various U.S. Patents classified in Art Classes 51–100 and 51–228 of the Manual of Classification of the United States Patent Office.

The instant inventor has directed his efforts to development of a superior machine. None of the above devices offer the combination of versatility, convenience of operation, and freedom from maintenance problems which is possessed by the apparatus of the present invention.

SUMMARY OF THE INVENTION

It is a principle object of the invention to provide an improved machine tool, a contour-machining apparatus which is particularly well adapted for the purpose of longitudinal and lateral contouring, and sharpening the edges of elongate articles such as blades of ice skates.

Another object of the invention is to provide a skate sharpener having an improved means for adjusting the effective longitudinal radius of a skate blade.

A further object of the invention is to provide a skate sharpener having an improved means of accurately determining the point of tangency of the blade.

A further object of the invention is to provide a skate sharpener which is easily manipulated and is highly resistant to fouling by abrasive grit.

Still another object of the invention is to provide novel means for quick-positioning a skate for sharpening and for quick detection of bends in skates to be sharpened.

Other objects of the invention will be obvious to those skilled in the art on their reading of this disclosure.

The above objects have been substantially achieved by construction of an apparatus having one or more of the following unique features:

1. A low-friction, abrasion resistant interface between a skate holding fixture and the surface on which it rests. This interface facilitates use of the machine over a very long period of time without excessive abrasion of the surface on which the skate fixture rests.

2. Means on said skate holding fixture to so modify the position of the skate relative to a sharpening wheel that the skate receives a longitudinal contour having any selected point of tangency. This feature is particularly important to hockey players. A defenseman may prefer the rearward position of his skate blade to be relatively high from the ice to facilitate his skating backwards; a forward may prefer an accentuated lift at the front end of his skate blade. The holding fixture also as a means to raise and lower the skate by a quick turn-bolt action and provides means to advance the skate position as the grinding wheels wear down, and blade material is ground away.

3. A blade-positioning indicator comprising a unique spring-balanced means, preferably mounted adjacent to a finishing wheel. The indicator provides visual means to confirm the precise positioning of a skate for a finishing step regardless of sakte blade thickness. It also can be utilized to detect a bent skate blade.

4. A rapid hand-adjustable means for changing the curvature to be ground into a skate blade. In the most advantageous embodiments of the invention, this curvature is, in reality an elliptical arc that, manifests itself, for all substantial purposes, as an effective radius. The means for setting the curvature is a slideable device having two pivot arms, adjustable in length, which work together forming a means to guide a skate, positioned on said arms through a repeatable pre-determined path with respect to an abrasive contouring wheel.

5. Skate height, with respect to the table upon which the skate-holder is moved (and consequently with respect to the abrasive sharpening wheels) may be set by a screw adjustment, only.

Figure 8A:
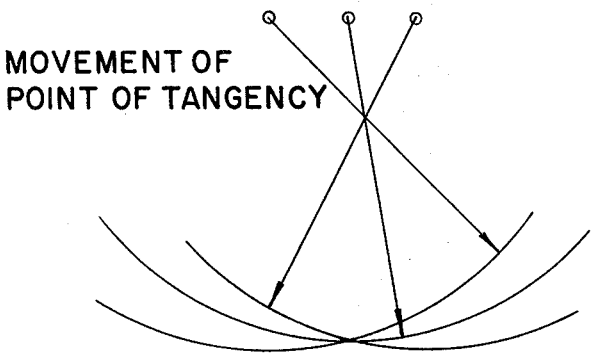
Figure 8B:
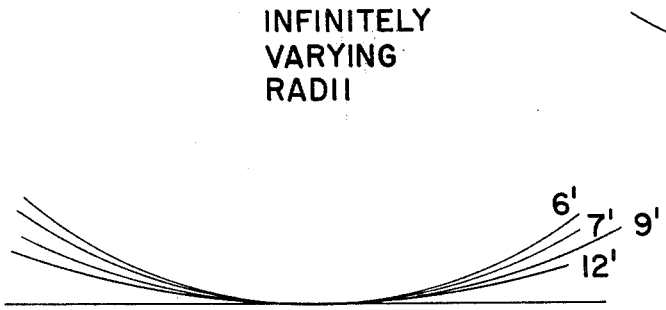

FIG. 8*a* and 8*b* show schematically various skate-blade configurations.

FIGS. 9 and 10 show an optional adjusting means and its relation to a grinding wheel and skate clamp.

FIGS. 11 through 13 show perspective end, and side views, respectively, of a novel skate-height measuring device.

Figure 2:
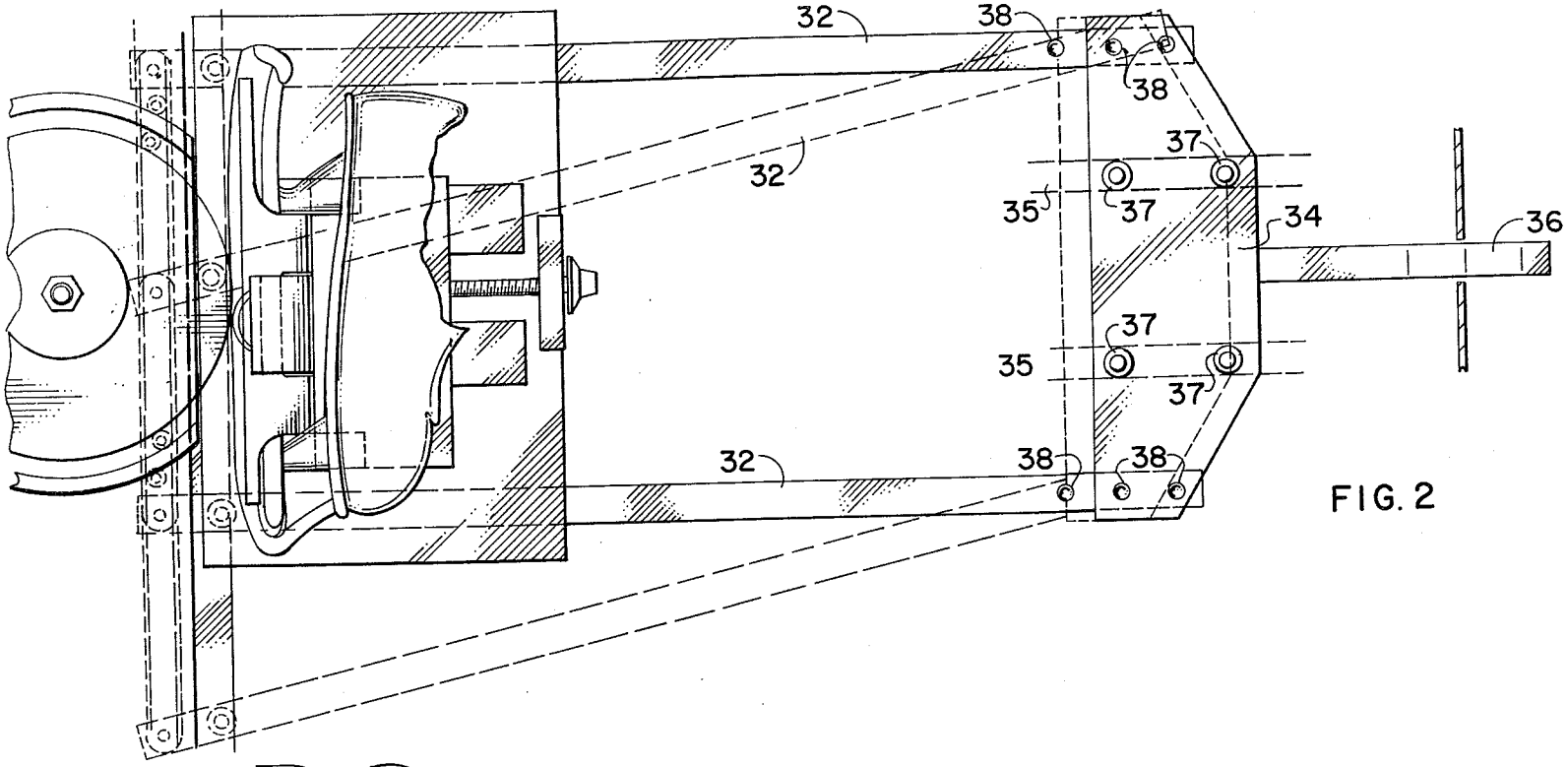
FIG. 2 is a side elevation of one of the sharpening stations, partially in section.
Figure 3:
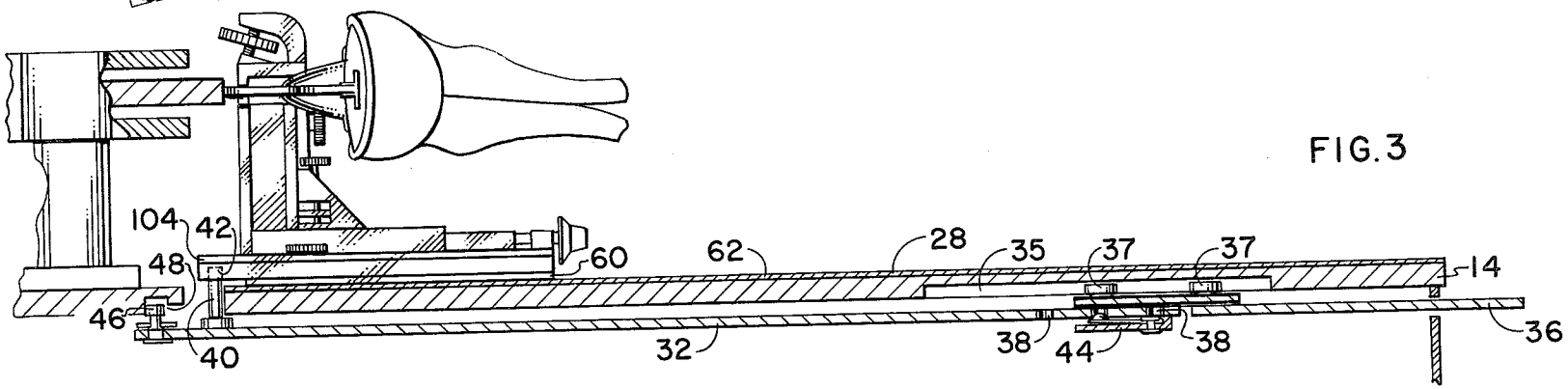
FIG. 3 is a plan view of the apparatus shown in FIG. 2.
Figure 14:
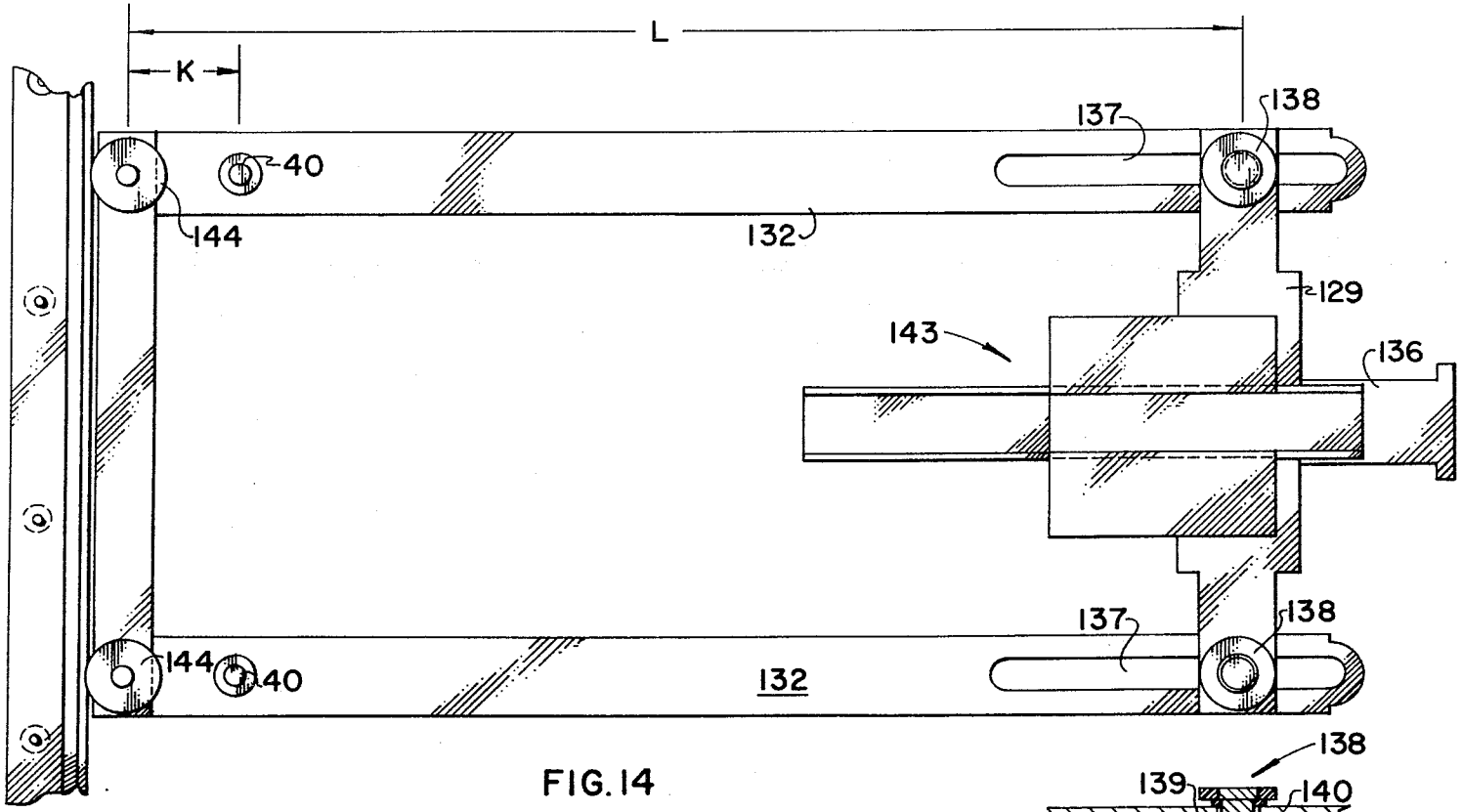
Figure 14A:
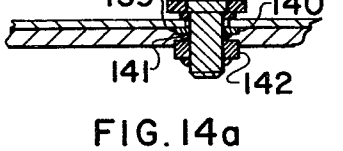
Figure 15:
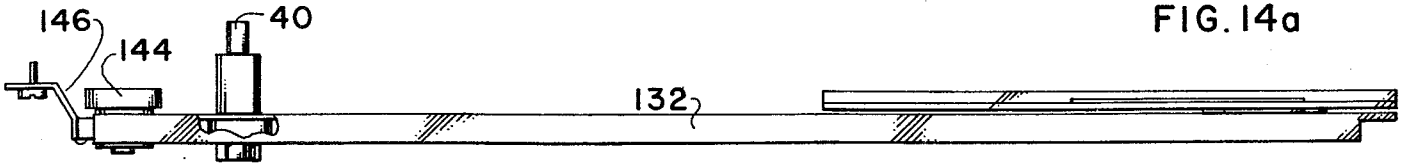

FIGS. 14, 14*a*, and 15, somewhat analagous to FIGS. 2 and 3, show an alternate means of adjusting the length of actuating arms upon which the skate is carried during the sharpening operation.

Figure 1:
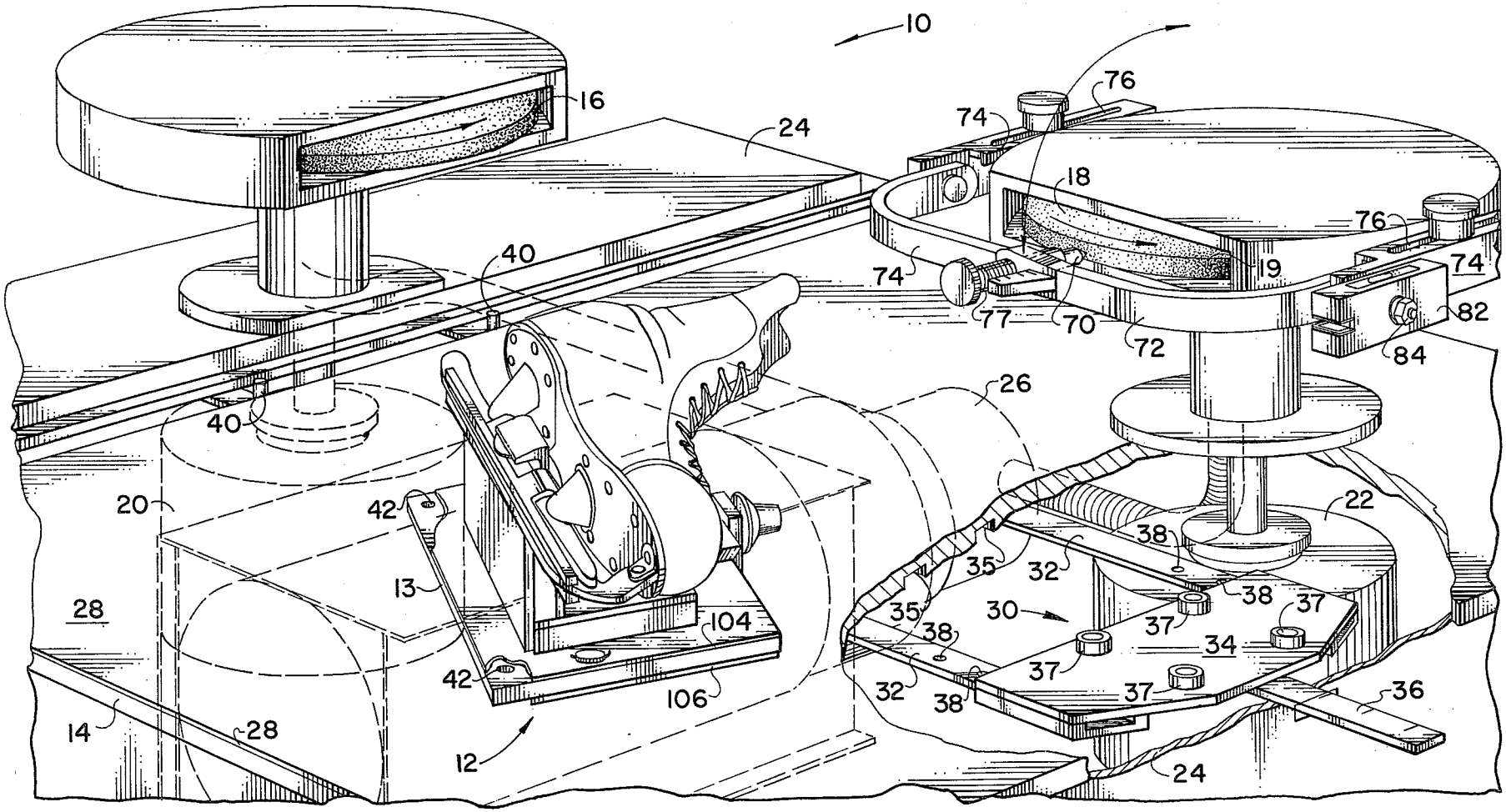
FIG. 1 is a perspective view of an apparatus of the invention showing the relative position of a work table and sharpening stations. The table is partially cut away to facilitate viewing of a positioning mechanism.

FIG. 1 illustrates an apparatus constructed according to the invention: Skate sharpening apparatus 10 comprises a skate-clamping assembly 12 which is adapted for manual sliding on table 14 to bring the skate blade into controlled contact with a contour grinding wheel 16 and a finish grinding wheel 18. These wheels are driven by electric motors 20 and 22 respectively. The motors are mounted beneath table 14 and within housing 24. A vacuum cleaning system 26 is also mounted within housing 24. It provides means to suck a major part of any grit abraded from each grinding wheel away from the wheel before it can contaminate surface 28 of table 14.

It should be noted that in most general purpose sharpening i.e. where blades in very poor condition are frequently encountered by the operator, wheel 16 will usually be mounted about a horizontal, rather than vertical, axis. Such a wheel allows faster "hogging" and yields substantially the same contours.

Actuator assembly 30 comprises actuator arms 32 which are pivotally attached to common plate, or sliding pivot carrier, 34, and are adapted for slideable adjustment by a handle 36. This slideable movement is facilitated by grooves 35 on the underside of table 14. Rollers 37 ride in grooves 35 and facilitate slideable movement of assembly 30. Holes 38 in arms 32 are part of indexing means whereby the effective pivot point of arms 32 at an end remote from the skate clamp may be determined. In front of, and beneath contour grinding wheel 16, are seen positioning pins 40. As is best seen in FIGS. 2 and 3, pins 40 form means to position skate clamping assembly 12 by insertion into apertures 42 in the skate holder. Note apertures 42 do not extend into top plate 104, but are limited to base plate 106.

Assuming a fixed position for pins 40 (as is shown in FIGS. 1 through 3) and the front end of arms 32 which carry rollers 46 for movement in a guide slot 48, the effective length of the actuator arms is determined only by the precise pair of holes 38 into which arms 32 are indexed by movement of handle 36. FIG. 3 illustrates a spring-loaded detent 44 which is adapted to snap into a selected pair of holes 38 to establish the rearmost loci of the pivot point of arms 32. As is seen in the drawings, arms 32 remain parallel to one another as they move. In general, arms 32 extend away from, and in a direction generally normal to, the skate blade.

FIGS. 9 and 10 show a modification of the apparatus shown in FIGS. 1–3. This is modification is an alternate embodiment of the invention which, in addition to providing primary means to adjust the effective length of arms 32, also provides means to adjust the distance between that point at which the skate holder is held at apertures 42 (corresponding to the approximate edge of the grinding wheel) and to rollers 46 which are mounted for movement along track 48 and form the frontmost pivoting end of arms 32.

FIGS. 9 and 10 show means whereby the distance K between skate attachment and terminal pivot loci along track 48 may be varied by use of a series of apertures 50 for receiving a drop bolts 52. Drop bolts 52, in this situation, perform the same function as pins 40 but allows a much greater flexibility (albeit, a flexibility not required at most sharpening facilities) in achieving the precise blade contour desired by an individual skater. Usually, distance K is maintained as a constant, because the fine adjustment made possible by varying K is not important to most skaters.

Figure 6:
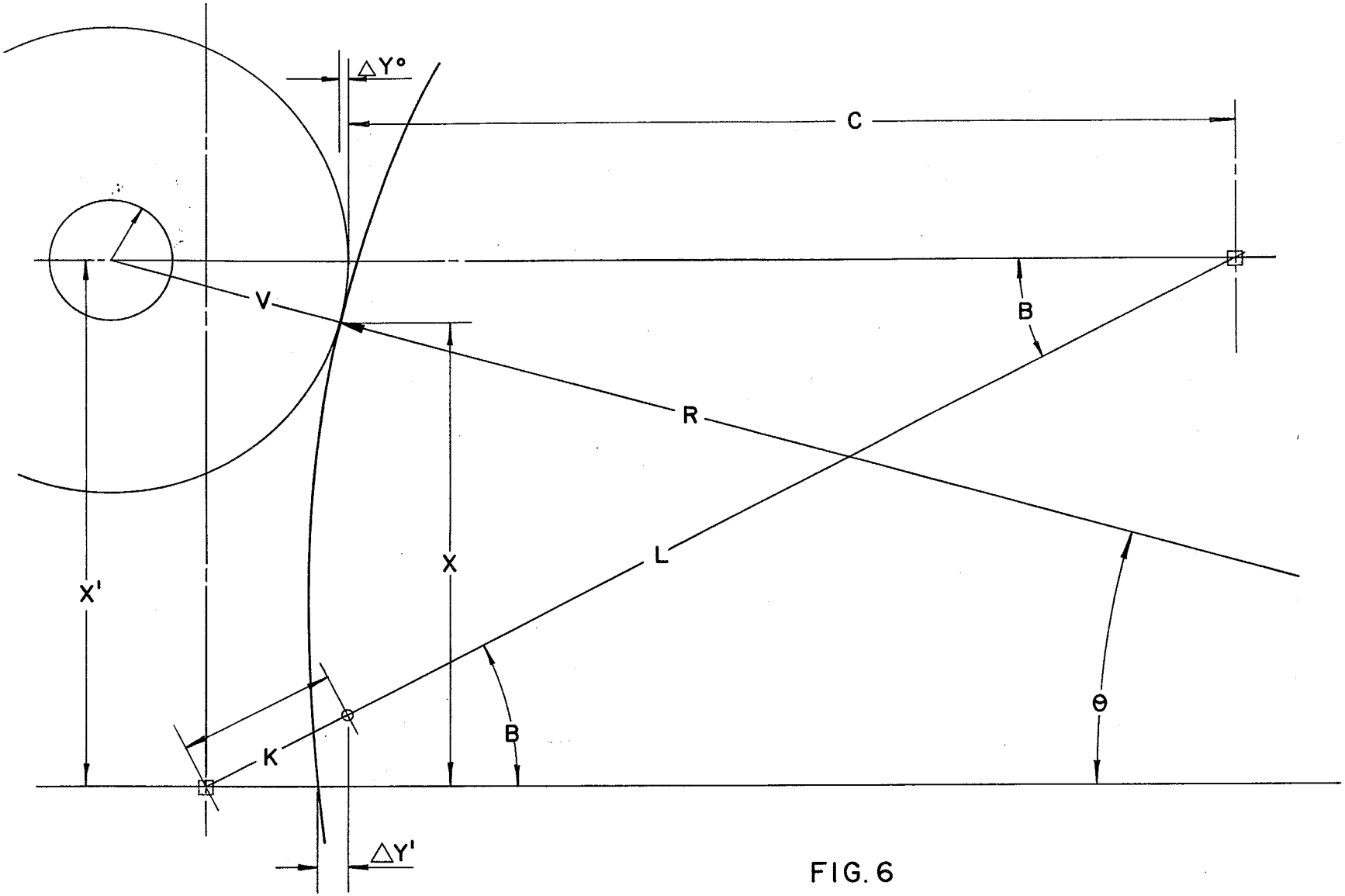
FIGS. 6 and 7 are descriptive of the various positioning mechanisms of the apparatus of the invention including optional positioning mechanisms and the effect thereof.
Figure 7:
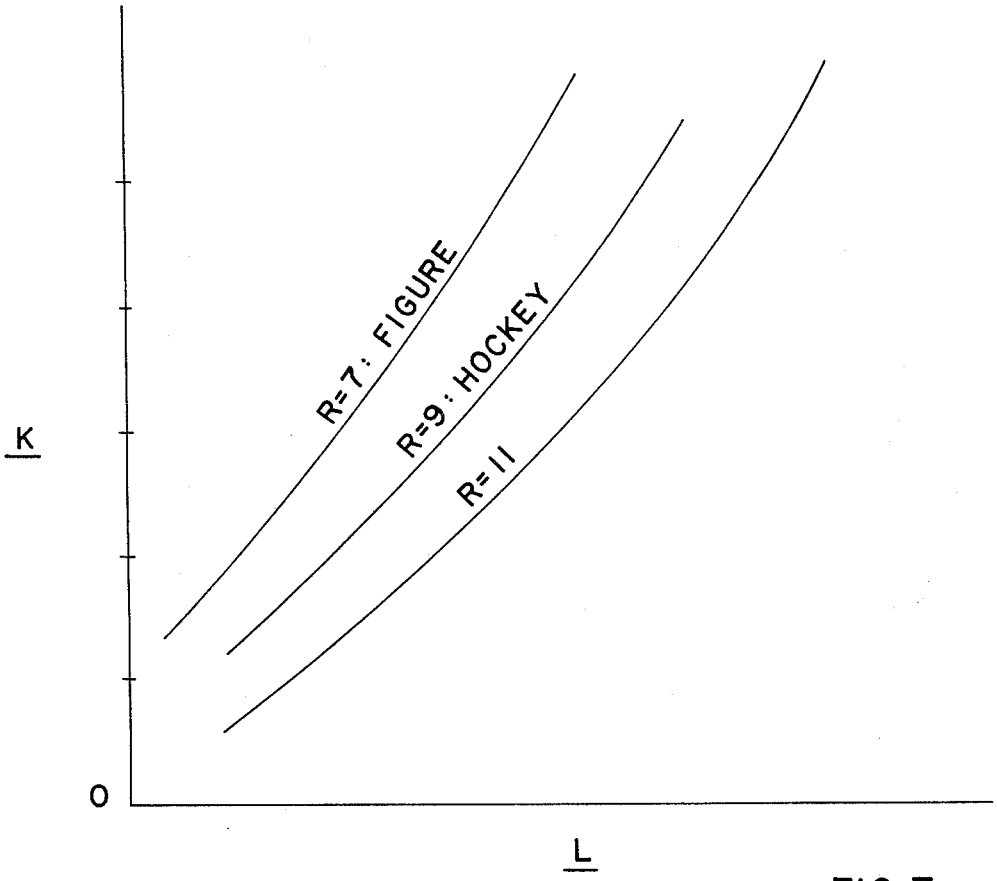

Referring to FIGS. 6 and 7, it is seen how varying either distance L (the length of actuator arms 32 between selected pivot holes 38 and pins 40) and distance K (the distance between pins 40 and the pivot loci of 46) can yield any of an infinite number of radius. In fact, the R used in FIG. 7 is more precisely an elliptical arc. However, in skate sharpening, (and in machining of similarily sized articles) this arc differs by about 0.001 inch from a true radius and thus can be considered a radius within terms of the skate-sharpening art.

FIGS. 8 and 8A show various means which the contour of the skate blade is modified. FIG. 8 is indicative of the infinite varying radii that may be achieved varying the distances K and L as discussed hereinabove.

FIG. 8*b* indicates the displaced center location achieved by swiveling the skate clamp on the skate holder as by use of slots 102 or other such means which provides that the angle between (a) the skate and (b) the positioning edge 13 of the skate-clamping assembly can be changed.

In practice, the desired longitudinal radii is achieved by merely moving the skate holder 12 laterally over the surface of table 14 while it is held on pins 40. When no extraordinary pressure is applied to the skate the desired contour will be achieved because of the path dictated for the skate blade by the dual arm rolling lever system, whereby assembly 12, connected to assembly 30 by pins 40, is guided across the face of abrasive wheel 16 while assembly 30 is held in constant relationship to the grinding wheel 16.

The connection between holder 12 and pin 40 is advantageously made sufficiently loose that overpressure exerted by the operator towards the wheel 16 will cause the holder to lift off the pins 40, thereby warning the operator that he is pressing too hard. A force of about 10 lbs is usually a suitable limit but the pin connection can be sized to meet any desired operating parameter or to avoid this feature of the apparatus entirely.

As has been indicated above, provision is made to remove abrasive grit waste from the vicinity of the sharpening operation by vacuum system 26. Nevertheless, it is inevitable that some such grit will get on table 14. In a surprisingly short time it will degrad a steel table surface sufficiently to interfere with the smooth operation of the sharpening operation.

To greatly ameliorate this problem, applicant has provided an improved low friction interface between skate holder 12 and the supporting table 14. This interface comprises (1) a polymeric fabric 60, advantageously a non-woven felt-type fabric, having interstices which tend to provide space into which small particles of grit tend to work themselves and (2) a resilient polymeric surface 62 which resists permanent deformation when subjected to the scoring of abrasive grit before it is either absorbed in the foresaid fabric or brushed off the table. The most satisfactory construction is the use of the fabric on bottom of the skate holder and the plastic on the top of the table. Of course, the use of the grit-absorbing fabric is beneficial with any smooth surface, not merely the most advantageous polymeric surfaces described below. Thus, polished steel, polycarbonate plastic, and polytetrafluoroethylene-coated anodized-hardcoat aluminum are useful table surfaces 28. However, relatively soft polymers, e.g. polyolefins such as polyethylene sold under the trade designation 1900 UHMW by Hercules Corporation or polyprophylene available under the trade designation are desirable. Static coefficient of friction is 0.18 for Polycohr vs Polycohr and 0.19 for Polycohr vs mild steel. Such a material is readily supplied in sheet stock and is preferably coated with a pressure-sensitive adhesive, thereby facilitating the renewal of the surface when it finally does wear excessively.

The grit-absorbing fabric is advantageously a nonwoven material such as the felt-like products sold under the term "Synthetic Fiber Felts" by GAF Corporation. Among the materials used are *Dacron Polyester*, polypropylene, polyamide and wools. Their density, based on a 1-inch thickness and square yard area, advantageously range from 4.5 to 8 lbs per $ft^3$. Air permeability per square foot for a 1/16-inch thickness is about 30 to 500 cfm at 0.5 inch $H_2O$ pressure. Compression recoveries of 70–95% are normally achieved after compression at 15 to 60 psi.

The very-low friction surface life can be further prolonged by the use of a solid-powder lubricant such as "Lub-aLite" sold by Mfg. Co. of Milwaukee. Among the more advantageous of such lubricants are those formed of very fine polytetrafluoroethylene powder of or other such low-friction polymers. These powder materials seem to act effectively on the contract surfaces which is surprising in view of the advantageous use of felt-like material.

Figure 5:
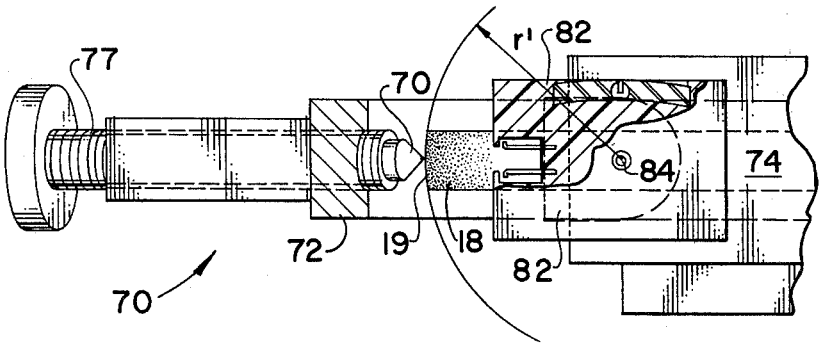
FIG. 5 is a view, partially in section of a hinged dressing tool assembly used on the apparatus of the invention.

After the contouring action is finished, it is usually desirable to dress the skate blade with a dressing wheel 18. Wheel 18 is provided a diamond dressing tool 70 which is screwed into pivot arm 72 and adapted to be swung between a dressing position (shown in FIGS. 1 and 5) and a storage position above wheel 18). Arm 72 is pivoted on a bracket 74. The bracket is slideably mounted in slots 76 of bracket-member 74. These slots allow gross adjustments in the relative position of dressing tool 70 and wheel 18; more precise adjustments in this relative positioning are made possible by screw adjustment 77. Tool 70 is generally adapted to be positioned at the center of the cylindrical face 19 of wheel 18. The position dressing tool 70 will advantageously be selected to have a radius peculiar to the use of a particular skate. For example, a goalie on a hockey team may prefer a 0.5 inch radius whereas the other players may want 1.5-inch radii on their skates.

An alternative arrangement to that shown in FIGS. 3 and 2 is shown in FIGS. 14 and 15. In this embodiment of the invention, the series of holes 38 in actuator arms 32 are replaced with elongate slots 137 and nylon friction disks 138 which allow the manual sliding of sliding pivot carries 129 along slots 37 but which resist spurious movement when the actuator arm has come to rest with the friction disks are left in motion-reistant contact with actuator arms 132. One advantage of this construction is the fact that it provides an infinite number of settings for the length of length *L* as disclosed in FIG. 8. Each friction disk assembly 138 comprises a shoulder washer 139, a pivot washer 140, a spring washer 141, and a self-locking nut 142. The handle means 142 for moving friction disk assemblies 138 is mounted in a slideway 143, thereby allowing the pivot points defined by the friction disks to be moved readily along slots 37.

It will also be seen in FIGS. 14 and 15 (which do not show the surface of table 14) that pins 40 are mounted to receive device skate mounting fixture 12. Rollers 144 at the end of arms 32 facilitate the movement of the actuator (or contouring) arms 32. Rollers 144 are further constrained by a roller support member 146.

An important aspect of finishing a skate properly is the exact positioning of the skate on the radius wheel. This is difficult to achieve with eye or by feel. In the usual situation, an operator will be faced with the problem of sharpening skates wherein the blade is of different metal and different thickness. Maintaining a well-centered finish location is difficult. Because this is so, applicant has furnished a novel and valuable height-indicating device 82 on the bracket 74 by a fastening means 84 of FIG. 11, indicating device 82 is pivotally mounted at 84.

Device 82 is also seen in FIGS. 11, 12 and 13. When a skate blade is forced into gap 86, it contacts and depresses flat springs 88, one on each side of the skate blade.

The springs, being of the ame mechanical characteristics, immediately deflect until they are equally deflected. Unless the skate is centered at the proper height in the skate clamp, the resultant forces will cause the device to pivot about 84 before this equilibrium position is reached.

Device 82 comprises a three-sided cover member 83, in which is mounted a housing member 85. A pivot pin and fastening means 84 is common to both cover 83 and housing 85. Flat springs 88 are mounted in housing 35 and clamped at one end thereof by means of clamp screws 94. These springs form a slot 86 (best seen in FIG. 13) which can receive a skate blade. The relative position of housing and cover can be changed by use of adjusting screw 91 which causes adjusting spring 92 to bear on housing 22 and shift the attitude of the housing with respect to cover 83. This adjustment is conveniently made with the device 82 mounted on the skate sharpener and prior to actual use.

When a skate blade is inserted into slot 86, each sensing spring 88 will tend to be deflected to equalize the forces thereon. If the skate blade is too high or too low with respect to the finishing wheel, the blade will force device 82 to pivot about 84 and the movement of the device will result in the movement of the bubble of bubble-type level 95 to an off-center position. The skate can then be raised or lowered to achieve proper centering by a height-adjusting means 103 on the skate clamp (See FIG. 4) as indicated by the level 95.

It will be noted that fit between housing 85 and cover member 83 is snug so that they will pivot together except when they are intentionally moved relative to each other by use of an adjusting means e.g. 91.

The device 82 allows a quick and acurate visual check for bent skates, and the location and seriousness of the bend. If a bent skate blade is inserted into the springs and slid therethrough, the bubble will move as the bend passes through the device. The degree of movement will indicate whether the bend is serious enough to warrant correction.

A skate-straightening device is advantageous attached to the apparatus of the invention.

Use of the positioning device 82 gives the operator a significant advantage over the manual methods previously used in the art. Visual inspection was probably no more accurate than about 0.010 inches. Much larger be incurred if the skate presented to the finish wheel had been ground at an angle. Indeed, some skaters may prefer a controlled angled bite on their skates in order to achieve a particular bite on the ice, one which accommodates their particular skating style. This can be accomplished in a repeatable and controlled way using the levelling device of the invention.

Figure 4:
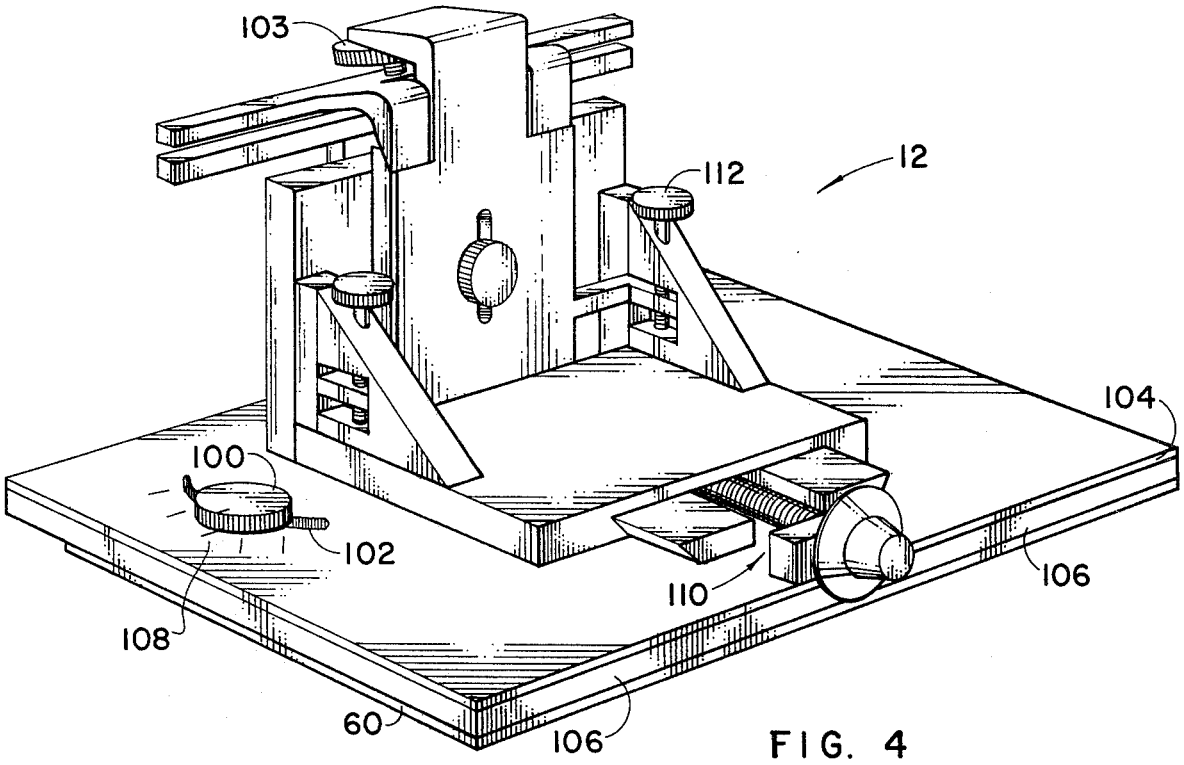
FIG. 4 is a blade-holding fixture adapted for use with the apparatus of the invention.

Another important aspect of the invention is a means to conveniently adjust the "center of radius" of the skate is shown in FIG. 4 whereby skate holder 12 is mounted for a slight swivelling action made possible by the use of a positioning bolts 100 which fit through arc-shaped slots 102 in steel plate 104 and are threaded into tapped holes in aluminum plate 106. When nuts 100 are loosened and the skate clamp is rotated clockwise, the result is that the backward point of the skate blade is sharpened to be higher off the ice (when the skate is mounted as shown in FIG. 1). This is desirable for forwards on a hockey team. Defensemen, who often skate backwards while performing their essential roles, may prefer the opposite, i.e. a skate sharpened with its rearward position closer to the ice. Screw adjustments 110 and 112 are used to advance the clamp on the fixture and adjust the height of the skate blade, respectively.

Again, an important aspect of the invention is the fact that such contours may be accurately and repeatedly achieved, by use of an angle-measuring scale 108 adjacent slots 102.

Although, the invention has been described largely in terms of apparatus comprising two abrasive wheels, it should be realized that less elaborate apparatus comprising the advantageous features of the invention can be constructed using a single wheel. In such a case, for example, the skate positioning aid would advantageously be mounted adjacent a contour wheel rather than the finishing wheel as described above.

It is to be understood that the following claims are intended to cover all of the generic and specific features of the invention herein described and all statements of the scope of the invention which might be said to fall therebetween.

I claim:

1. In a mchining apparatus for forming a contoured surface by carrying an article to be contoured across the face of an abrasive grinding wheel in a predetermined path, the improvement wherein said apparatus comprises a. clamp means for mounting said article in a predetermined attitude relative to said grinding tool;

b. carrier means for said clamp, said carrier means pivotally attached to said clamp and adapted to move said clamp through a predetermined accurate path relative to said grinding tool;

c. said carrier means comprising two elongate parallel arms each adapted for pivotal attachment to said clamp and each arm (1) pivotally attached to said apparatus at an end thereof remote from said clamp, and (2) pivotally and slideably supported at an end thereof proximate said clamp, said elongate arms so attached to said apparatus and said clamp to be parallel during pivotal movement thereof;

d. and arm-length-adjusting means proximate the end of said arms remote from said clamp forming means to change the length of both arms and, consequently, the effective length of said parallel arms, and the effective path of said clamp means, as said arms move in parallel in response to the clamp means being moved across the face of said grinding wheel.

2. Apparatus as defined in claim 1 wherein placement of the pivotal attachment of said arms remote from said clamp is achieved by slideable friction-disk means and, consequently, forms means to achieve an infinite number of positions for said pivotal attachment.

3. Apparatus as defined in claim 1 wherein said arms comprise mechanical means to independently adjust the distance between (a) the point of attachment of said arms to said clamp and (b) the point of slideable support of said arms proximate said clamp.

4. Apparatus as defined in claim 2 wherein said arms comprise mechanical means to independently adjust the distance between (a) the point of attachment of said arms to said clamp and (b) the point of slideable support of said arms proximate said clamp.

5. Apparatus as defined in claim 1 wherein said clamp means is mounted on a table and comprises 1. a support plate forming means for slideable movement over said table;
2. a skate-holding assembly on said support plate; and
3. means to adjust the relative angular position of skate-holding assembly with respect to the path of said clamp means as it is carried past said grinding wheel.

6. Apparatus as defined in claim 5 wherein said table and said support plate form a slideable interface one surface of which is comprised of 1. a grit absorbing fabric material as bottom surface of said support plate and
2. a resilient polymeric surface on said table or a polymeric treated hardened metal surface.

7. Apparatus as defined in claim 6 wherein said polymeric surface is formed of a polyolefin polymer and said grit absorbing surface is a felt product.

8. Apparatus as defined in claim 1 and wherein the pivoted attachment between said arms and said clamp means are pins projecting from said actuator arms in a base plate of said clamp means, said attachment being such that said clamp will be pushed off said pins if force exerted toward said grinding wheel exceeds a predetermined force.

9. Apparatus as defined in claim 5 wherein the pivoted attachment between said arms and said clamp means are pins projecting from said actuator arms in a base plate of said clamp means, said attachment being such that said clamp will be pushed off said pins if force exerted toward said grinding wheel exceeds a predetermined force.

10. Apparatus as defined in claim 7 and wherein the pivoted attachment between said arms and said clamp means are pins projecting from said arms in a base pl. of said clamp means, said attachment being such that said clamp will be pushed off said pins if force exerted toward said grinding wheel exceeds a predetermined force.

11. Apparatus as defined in claim 1 additionally comprising means for indicating a predetermined vertical positioning of a workpiece edge in relationship to an abrasive grinding wheel, said facilitating means being pivotally mounted adjacent said grinding wheel and comprising 1. two opposed flat springs, said flat springs spaced to form a slot adapted to receive said workpiece edge, said springs forming means to pivot said indicating means until forces exerted on said springs are equal;

2. a housing member for said flat springs onto which an end of each said spring is clamped at a position between said pivotal mounting and said slot; and 3. a bubble-type level-detecting means adapted to give a visual indication of whether or not the indicating means is pivoted from said predetermined position by a said workpiece inserted in said slot between said springs.

12. Apparatus as defined in claim 11 wherein said housing is pivotally mounted in a cover and comprises a screw-adjustment connection between said cover and housing to adjust the angular relationship one to the other, thereby facilitating setting a zero-point for said level when it is placed on a machine.

* * * * *